US006536593B2

(12) United States Patent
Hatakeyama

(10) Patent No.: US 6,536,593 B2
(45) Date of Patent: Mar. 25, 2003

(54) EMBOSSED CARRIER TAPE

(75) Inventor: Hitoshi Hatakeyama, Miyazaki (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 09/755,057

(22) Filed: Jan. 8, 2001

(65) Prior Publication Data

US 2002/0005370 A1 Jan. 17, 2002

(30) Foreign Application Priority Data

Jul. 11, 2000 (JP) ..... 2000-209194

(51) Int. Cl.[7] ..... B65D 73/02
(52) U.S. Cl. ..... 206/714; 206/725
(58) Field of Search ..... 206/714, 725, 206/820, 390

(56) References Cited

U.S. PATENT DOCUMENTS 4,898,275 A * 2/1990 Skrtic et al. ..... 206/714
5,076,427 A * 12/1991 Thomson et al. ..... 206/714
5,152,393 A * 10/1992 Chenoweth ..... 206/714
5,265,723 A * 11/1993 Chenoweth et al. ..... 206/714
5,499,717 A * 3/1996 Hayashi ..... 206/714
5,964,353 A * 10/1999 Hamlin ..... 206/714
6,076,681 A * 6/2000 Chenoweth ..... 206/714
6,142,306 A * 11/2000 Mori et al. ..... 206/714
6,176,373 B1 * 1/2001 Kato et al. ..... 206/714
6,179,127 B1 * 1/2001 Kato et al. ..... 206/714
6,216,419 B1 * 4/2001 Sakurai ..... 206/714

* cited by examiner

*Primary Examiner*—Bryon P. Gehman
(74) *Attorney, Agent, or Firm*—Rabin & Berdo, PC

(57) ABSTRACT

An embossed carrier tape used for carrying electronic devices, includes a plurality of pockets in which the electronic devices are held. Each of the pockets includes a plurality of inner side surfaces which are separated by ridge lines. Each of the pockets is shaped so that corners of the electronic device are not in contact with the ridge lines thereof.

8 Claims, 10 Drawing Sheets

EMBOSSED CARRIER TAPE

CROSS REFERENCE TO RELATED APPLICATION

This application claims the priority of Application No. 2000-209194, filed Jul. 11, 2000 in Japan, the subject matter of which is incorporated herein by reference.

TECHNICAL FIELD OF THE INVENTION

The present invention relates to an embossed carrier tape for holding and packaging small-sized electronic devices such as a semiconductor device, a capacitor, a resistor, etc.

BACKGROUND OF THE INVENTION

An embossed carrier tape is generally used to hold and package small-sized electronic devices such as a semiconductor device, a capacitor, a resistor, etc. A conventional embossed carrier tape includes a plurality of pockets (device holes) in which electronic devices are put one by one. Each of the pockets (device holes) is shaped to be a reverse quadrangular pyramid having an inner side surface and a bottom surface. An electronic device is in contact at bottom edges with the inner side surface, and at the corners with the ridge lines of the pocket (device hole).

According to the conventional embossed carrier tape, the electronic devices are unstable in position and easily moved within the pockets (device holes), because the electronic devices are so small and light. When an electronic device is moved and offset in the pocket (device hole), the package is supported only at the four corners. The position offset of the electric device raises an inability to take out the electronic devices from the device holes upon their unpackaging in a subsequent process, etc.

OBJECTS OF THE INVENTION

Accordingly, an object of the present invention is to provide an embossed carrier tape in which electronic devices are held and carried stably without offset of position.

Additional objects, advantages and novel features of the present invention will be set forth in part in the description that follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

According to a first aspect of the present invention, an embossed carrier tape used for holding and carrying electronic devices, includes a plurality of pockets (device holes) in which the electronic devices are held one by one. Each of the pockets (device holes) is shaped to be a reverse quadrangular pyramid having four inner side surfaces which are separated by ridge lines. Each of the pockets (device holes) is shaped so that corners of an electronic device are not in contact with the ridge lines thereof.

According to the present invention, electronic devices are kept in position proper and stably in the pockets (device holes). As a result, it is easy to adsorb or catch such electronic devices when picking up out of the pocket (device hole).

DETAILED DISCLOSURE OF THE INVENTION

In the following detailed description of the preferred embodiments, reference is made to the accompanying drawings which forma part hereof, and in which is shown by way of illustration specific preferred embodiments in which the inventions may be practiced. These embodiments are described in sufficient detail to enable those skilled in the art to practice the invention, and it is to be understood that other embodiments may be utilized and that logical, mechanical and electrical changes may be made without departing from the spirit and scope of the present inventions. The following detailed description is, therefore, not to be taken in a limiting sense, and scope of the present inventions is defined only by the appended claims.

Figure 1:
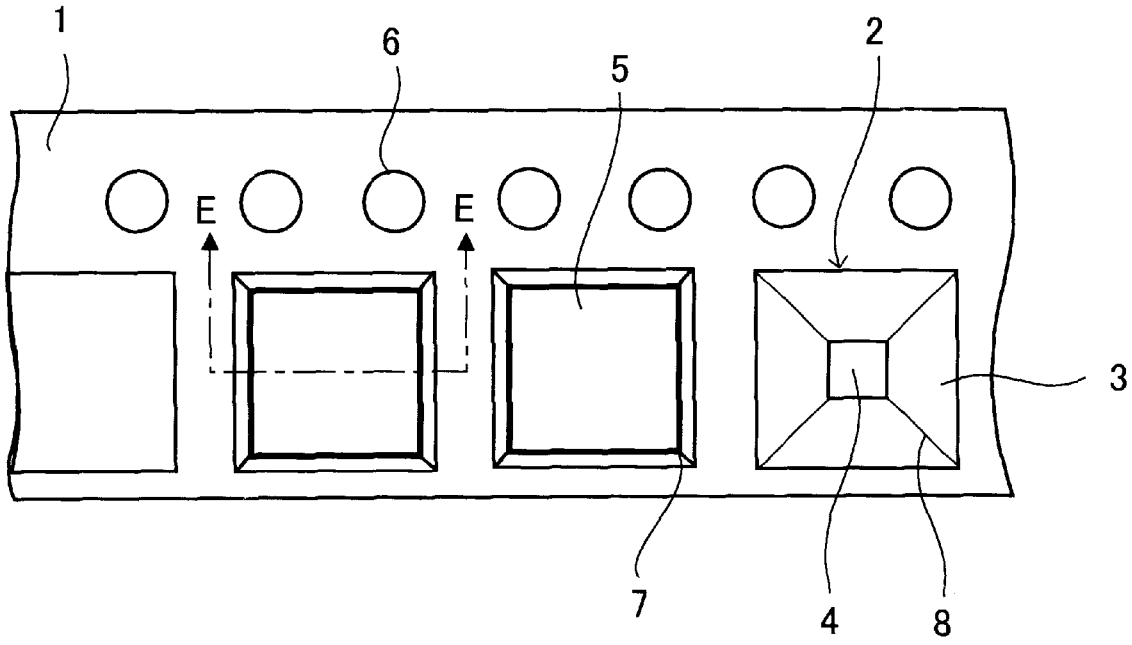
FIG. 1 is a plan view showing a part of a conventional embossed carrier tape.
Figure 2:
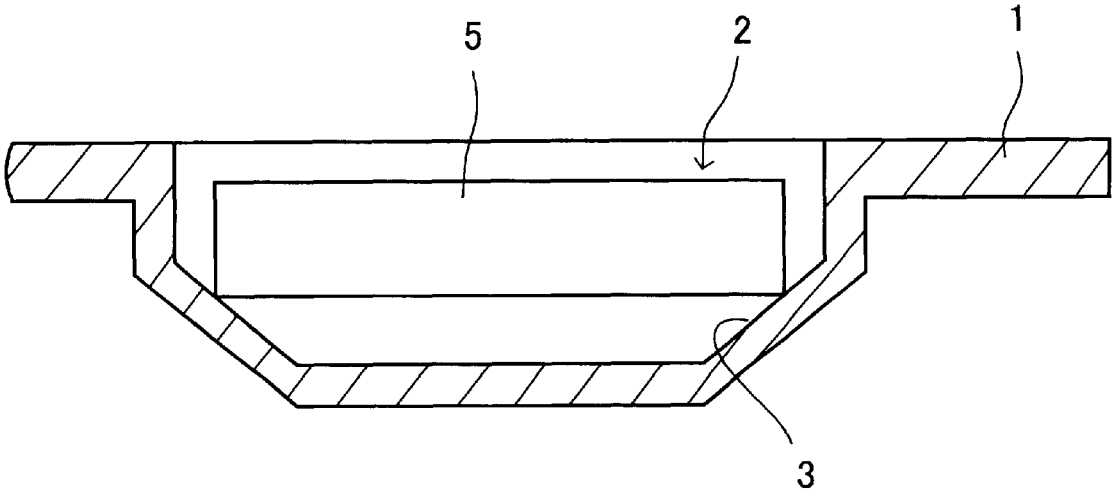
FIG. 2 is a cross-sectional view taken on line E—E in FIG. 1.

For better understanding the present invention, a conventional technology is first described. FIG. 1 shows a conventional type of embossed carrier tape used for containing and carrying electronic devices, such as, BGA (Ball Grid Array) type of semiconductor packages, LGA (Land Grid Array) type of semiconductor packages or CSPs (Chip Size Package). FIG. 2 shows how an electronic device is held in the embossed carrier tape.

The conventional embossed carrier tape 1 includes a plurality of pockets (device holes) 2 in which electronic devices 5 are put one by one. Each of the pockets (device holes) 2 is shaped to be a reverse quadrangular pyramid having an inner side surface 3 and a bottom surface 4. The embossed carrier tape 1 further includes sprocket holes 6. An electronic device 5 is in contact at its bottom edges with the inner side surface 3, and at its corners 7 with the ridge lines 8 of the pocket (device hole) 2.

According to the conventional embossed carrier tape 1, the electronic devices 5 are unstable in position and easily moved within the pockets (device holes) 2, because the electronic devices 5 are so small and light. When an electronic device 5 is moved and offset in the pocket (device hole) 2, the package is supported only at the four corners 7. As a result, it is not easy to adsorb or catch such an offset package when taken out of the pocket (device hole) 2.

First Preferred Embodiment

Figure 3:
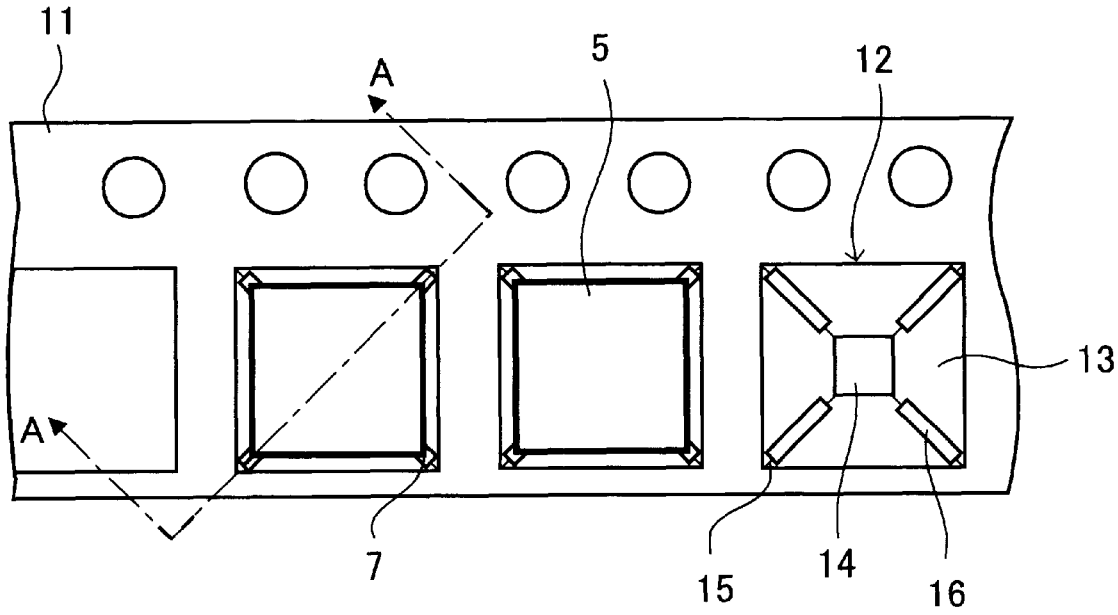
FIG. 3 is a plan view showing a part of an embossed carrier tape according to a first preferred embodiment of the present invention.
Figure 4:
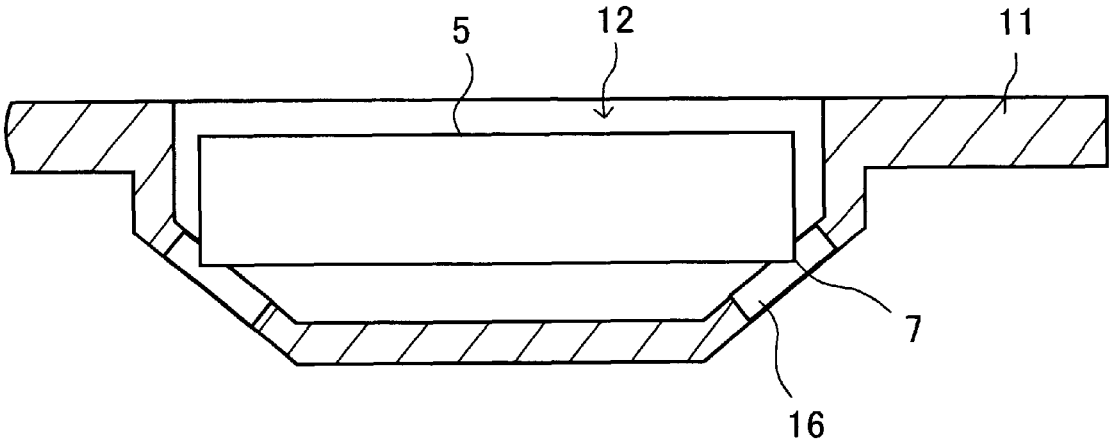
FIG. 4 is a cross-sectional view taken on line A—A in FIG. 3.

FIG. 3 is a plan view showing a part of an embossed carrier tape according to a first preferred embodiment of the present invention. FIG. 4 is a cross-sectional view taken on line A—A in FIG. 3. An embossed carrier tape 11 according to the first preferred embodiment includes a plurality of pockets (device holes) 12 in which electronic devices 5 are held. Each of the pockets (device holes) 12 is shaped to be a reverse quadrangular pyramid having inner side surfaces 13, a bottom surface 14 and openings 16. The inner side surfaces are separated by ridge lines (inside edge line). The openings 16 are formed along the ridge lines (inside corner lines) 15.

An electronic device 5 is supported around its corners 7 in the concavity 27. The corners 7 of the electronic device 5 are not in contact with the inner side surface 23 or the ridge lines 25. Each of the concavities 27 is formed integrally with the embossed carrier tape 21, so that an electronic device 5 is in contact at the bottom with two points in the concavity 27. As a result, the electronic device 5 is stable in position within the pocket (device hole) 22. Even if the electronic device 5 is moved and offset in the pocket (device hole) 22, the electronic device 5 is easily recovered to its original or proper position.

The bottom edges of the electronic device 5 are stably and reliably in contact with the inner side surfaces 13 in the pocket (device hole) 12. As described above, according to the first preferred embodiment of the present invention, the electronic devices 5 are kept in position proper and stably in the pockets (device holes) 12. As a result, it is easy to adsorb or catch such electronic devices when picking up out of the pocket (device hole) 12.

Second Preferred Embodiment

Figure 5:
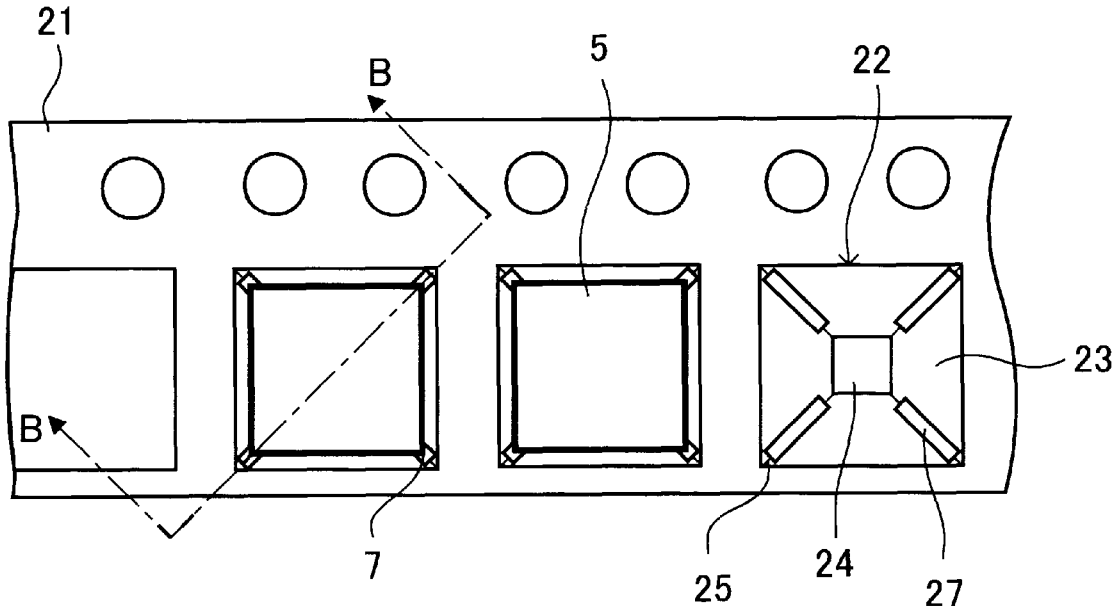
FIG. 5 is a plan view showing a part of an embossed carrier tape according to a second preferred embodiment of the present invention.
Figure 6:
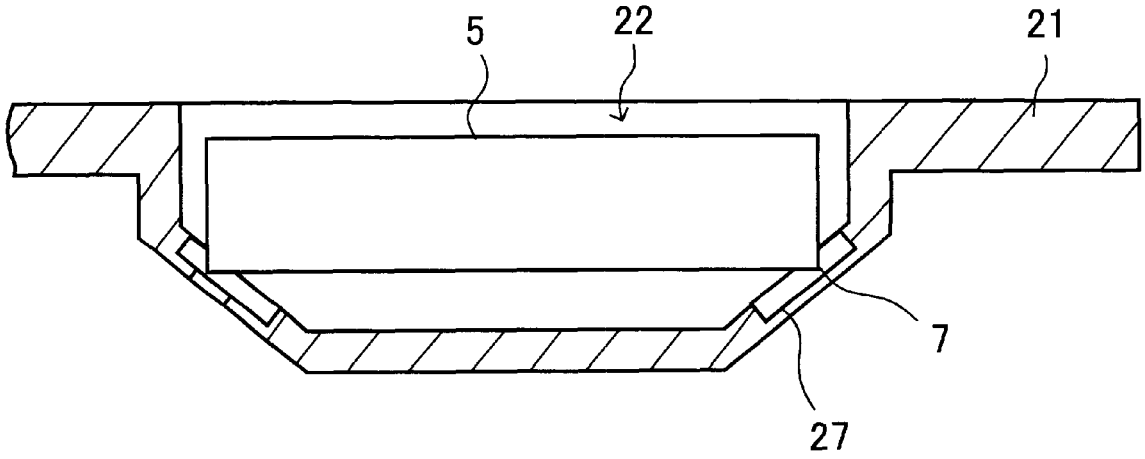
FIG. 6 is a cross-sectional view taken on line B—B in FIG. 5.

FIG. 5 is a plan view showing a part of an embossed carrier tape according to a second preferred embodiment of the present invention. FIG. 6 is a cross-sectional view taken on line B—B in FIG. 5. An embossed carrier tape 21 according to the second preferred embodiment includes a plurality of pockets (device holes) 22 in which electronic devices 5 are held. Each of the pockets (device holes) 22 is shaped to be a reverse quadrangular pyramid having inner side surfaces 23, a bottom surface 24 and concavities 27. The inner side surfaces are separated by ridge lines (inside edge line). The concavities or depressed parts are formed along ridge lines (inside corner lines) 25.

An electronic device 5 is supported around corners 7 in the concavity 27. The corners 7 of the electronic device 5 are not in contact with the inner side surface 23 or the ridge lines 25. Each of the concavities 27 is formed integrally with the embossed carrier tape 21, so that an electronic device 5 is in contact at the bottom with two points in the concavity 27. As a result, the electronic device 5 is stable in position within the pocket (device hole) 22. Even if the electronic device 5 is moved and offset in the pocket (device hole) 22, the electronic device 5 is easily recovered to its original or proper position.

The bottom edges of the electronic device 5 are stably and reliably in contact with the inner side surfaces 23 in the pocket (device hole) 22. As described above, according to the second preferred embodiment of the present invention, the electronic devices 5 are kept in position proper and stable in the pockets (device holes) 22. As a result, it is easy to adsorb or catch such electronic devices when picking up out of the pocket (device hole) 22.

Third Preferred Embodiment

Figure 7:
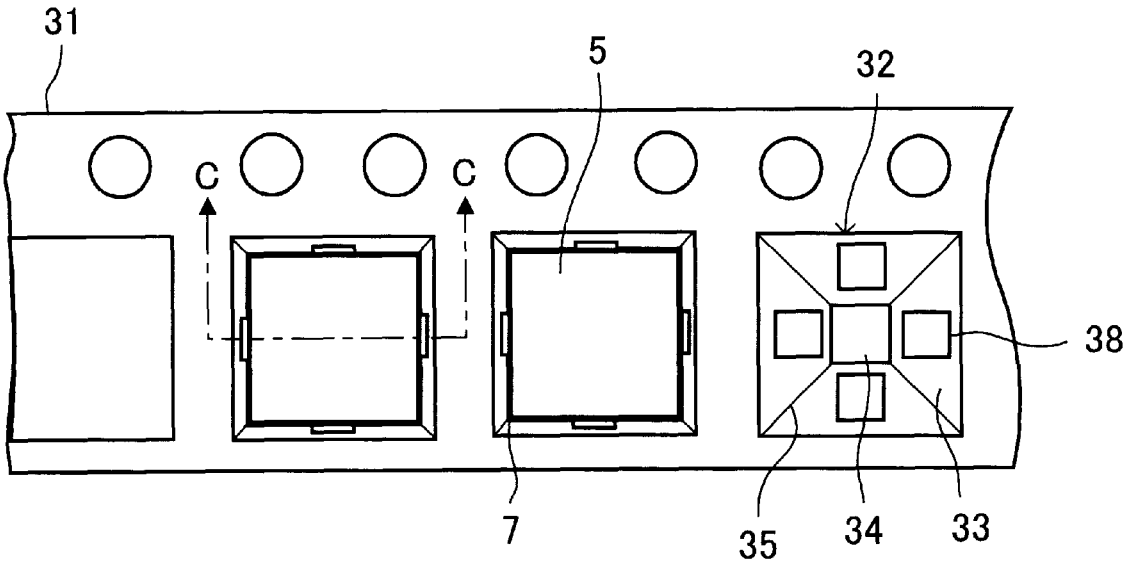
FIG. 7 is a plan view showing a part of an embossed carrier tape according to a third preferred embodiment of the present invention.
Figure 8:
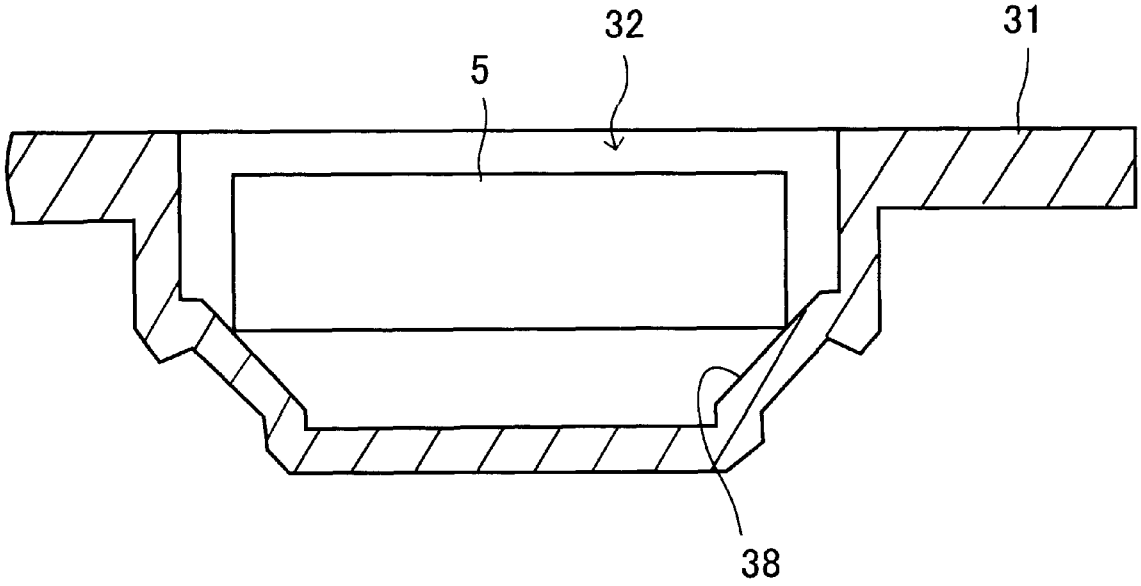
FIG. 8 is a cross-sectional view taken on line C—C in FIG. 7.

FIG. 7 is a plan view showing a part of an embossed carrier tape according to a third preferred embodiment of the present invention. FIG. 8 is a cross-sectional view taken on line C—C in FIG. 7. An embossed carrier tape 31 according to the third preferred embodiment includes a plurality of pockets (device holes) 32 in which electronic devices 5 are held. Each of the pockets (device holes) 32 is shaped to be a reverse quadrangular pyramid having an inner side surface 33, a bottom surface 34 and convex parts 38. The inner side surfaces are separated by ridge lines (inside edge line). Each of the convex (projected) parts 38 is shaped to be square and is formed on each of the inner side surfaces 33. In other words, the convex parts 38 are projecting from the inner side surfaces 33.

As shown in FIG. 8, an electronic device 5, supported in the corresponding pocket (device hole) 32, is only contact at the bottom edges with the convex parts 38 but is not contact at its corners 7 with the inner side surfaces 33 or ridge lines 35. Each of the convex parts 38 is formed integrally with the embossed carrier tape 31. The convex parts 38 may be shaped to be other than square.

As described above, according to the third preferred embodiment of the present invention, the electronic devices 5 are kept in position proper and stable in the pockets (device holes) 32. As a result, it is easy to adsorb or catch such electronic devices when picking up out of the pocket (device hole) 32. Further, according to the third preferred embodiment, the electronic devices 5 are only contact with the convex parts 38, so that a contact area with the pockets (device holes) 32 is small. And therefore, the electronic device 5 are easily moved back or recovered to its proper or original position even if the packages are undesirably moved and offset.

Fourth Preferred Embodiment

Figure 9:
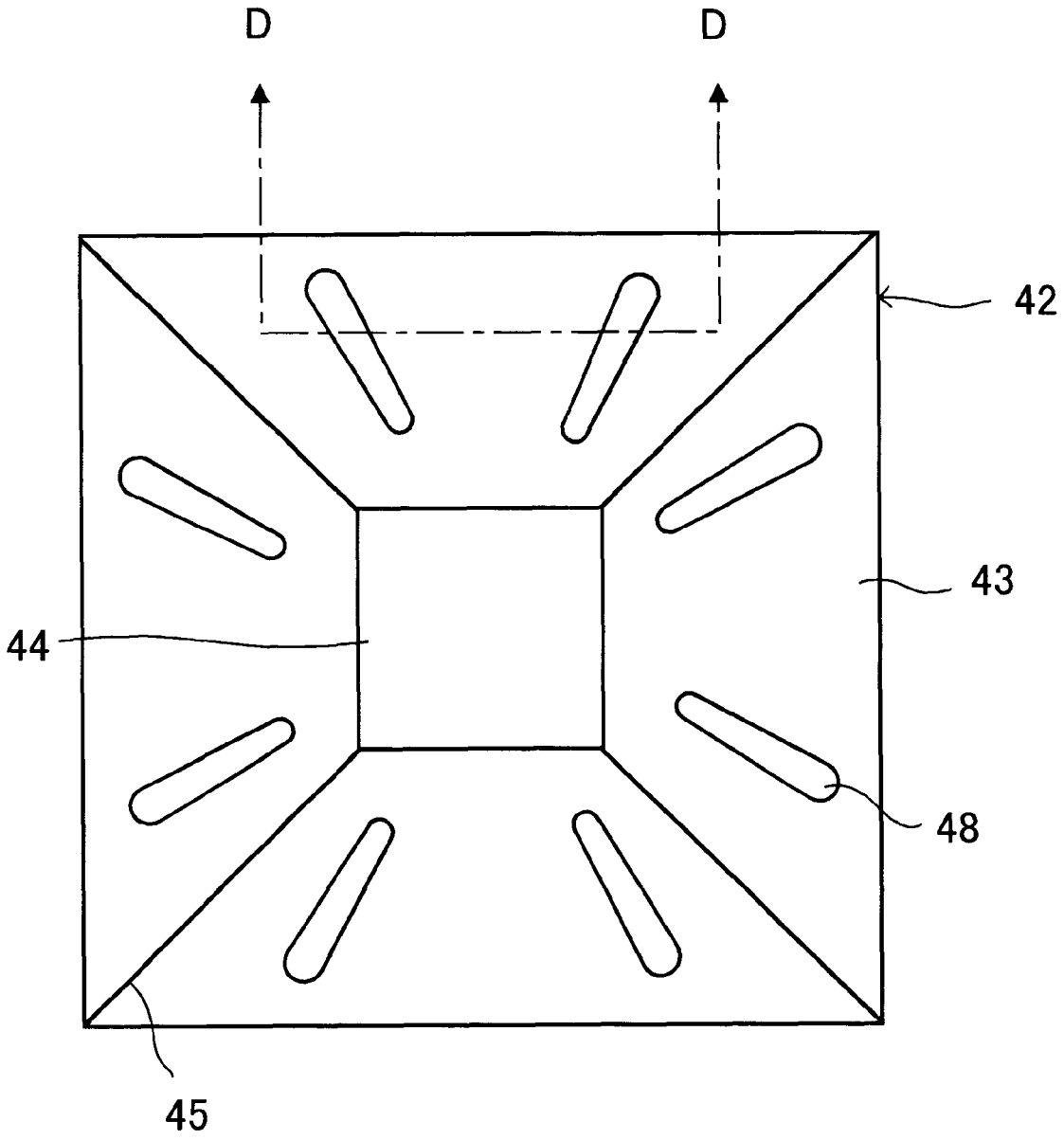
FIG. 9 is a plan view showing a part of an embossed carrier tape according to a fourth preferred embodiment of the present invention.
Figure 10:
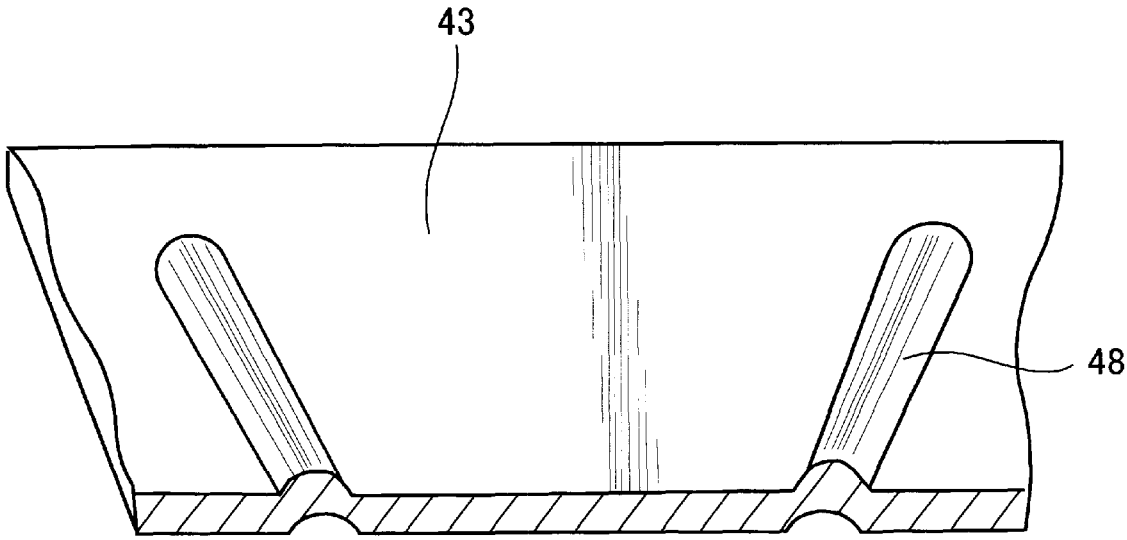
FIG. 10 is a cross-sectional view taken on line D—D in FIG. 9.

FIG. 9 is a plan view showing a part (pocket (device hole)) of an embossed carrier tape according to a fourth preferred embodiment of the present invention. FIG. 10 is a cross-sectional view taken on line D—D in FIG. 9. An embossed carrier tape according to the fourth preferred embodiment includes a plurality of pockets (device holes) 42 in which electronic devices are held. Each of the pockets (device holes) 42 is shaped to be a reverse quadrangular pyramid having an inner side surface 43, a bottom surface 44 and convex parts 48. The inner side surfaces are separated by ridge lines (inside edge line). Each of the convex parts 48 is bar-shaped and is extending in a radial direction. On each of the inner side surfaces 43, two of the convex parts 48 are formed.

An electronic device, supported in the corresponding pocket (device hole) 42, is only contact at its bottom edges with the convex parts 48 but is not contact at its corners with the inner side surfaces 43 or ridge lines 45. The convex parts 48 are formed integrally with the embossed carrier tape. Each of the convex parts 48 is shaped to have a round top surface and to extend along the taper of the inner side surface 43.

As described above, according to the fourth preferred embodiment of the present invention, the electronic devices are kept in position proper and stable in the pockets (device holes) 42. As a result, it is easy to adsorb or catch such electronic devices when picking up out of the pocket (device hole) 42. Further, according to the fourth preferred embodiment, the electronic devices are only contact with the convex parts 48, so that a contact area with the pockets (device holes) 42 is small. And therefore, the electronic device are easily moved back or recovered to its proper or original position even if the packages are undesirably moved and offset.

What is claimed is:

1. An embossed carrier tape used for carrying electronic devices, comprising:

a plurality of pockets, each of which stores a respective electronic device, each pocket having a plurality of inner side surfaces which collectively define the pocket to have a reverse quadrangular pyramidal shape, each inner side surface being separated from an adjacent inner side surface by a ridge line, wherein when the electronic device is stored in a respective pocket, bottom edges of the electronic device are in contact with, so as to be supported by, the inner side surfaces of the pocket, and corners of the electronic device are free of contact with the ridge lines and the inner side surfaces, and wherein each of the pockets has an opening at each of the respective ridge lines so that the corners of the electronic devices are inserted and held therein.

2. An embossed carrier tape according to claim 1, wherein the openings are formed as a unitary body with the embossed carrier tape.

3. An embossed carrier tape used for carrying electronic devices, comprising:

a plurality of pockets, each of which stores a respective electronic device, each pocket having a plurality of inner side surfaces which collectively define the pocket to have a reverse quadrangular pyramidal shape, each inner side surface being separated from an adjacent inner side surface by a ridge line, wherein when the electronic device is stored in a respective pocket, bottom edges of the electronic device are in contact with, so as to be supported by, the inner side surfaces of the pocket, and corners of the electronic device are free of contact with the ridge lines and the inner side surfaces, and wherein each of the pockets has a concavity formed at each of the respective ridge lines so that the corners of the electronic devices are inserted and held therein.

4. An embossed carrier tape according to claim 3, wherein the concavities are formed as a unitary body with the embossed carrier tape.

5. An embossed carrier tape used for carrying electronic devices, comprising:

a plurality of pockets, each of which stores a respective electronic device, each pocket having a plurality of inner side surfaces which collectively define the pocket to have a reverse quadrangular pyramidal shape, each inner side surface being separated from an adjacent inner side surface by a ridge line, wherein when the electronic device is stored in a respective pocket, bottom edges of the electronic device are in contact with, so as to be supported by, the inner side surfaces of the pocket, and corners of the electronic device are free of contact with the ridge lines and the inner side surfaces, wherein each of the inner side surfaces includes a convex part, with the bottom edges of the electronic device being in contact with the convex part, and wherein each of the convex parts is shaped to be square.

6. An embossed carrier tape according to claim 5, wherein the convex parts are formed as a unitary body with the embossed carrier tape.

7. An embossed carrier tape used for carrying electronic devices, comprising:

a plurality of pockets, each of which stores a respective electronic device, each pocket having a plurality of inner side surfaces which collectively define the pocket to have a reverse quadrangular pyramidal shape, each inner side surface being separated from an adjacent inner side surface by a ridge line, wherein when the electronic device is stored in a respective pocket, bottom edges of the electronic device are in contact with, so as to be supported by, the inner side surfaces of the pocket, and corners of the electronic device are free of contact with the ridge lines and the inner side surfaces, wherein each of the inner side surfaces includes at least one bar-shaped convex part, with the bottom edges of the electronic device being in contact with the convex part, and wherein each of the inner side surfaces includes a plurality of the convex parts.

8. An embossed carrier tape according to claim 7, wherein the convex parts are formed as a unitary body with the embossed carrier tape.

* * * * *